US008925445B2

(12) United States Patent
Park et al.

(10) Patent No.: US 8,925,445 B2
(45) Date of Patent: Jan. 6, 2015

(54) COOKING APPLIANCE

(75) Inventors: Jae-Hyoun Park, Seoul (KR); Young-Soo Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 614 days.

(21) Appl. No.: 13/263,968

(22) PCT Filed: Sep. 3, 2009

(86) PCT No.: PCT/KR2009/004959
§ 371 (c)(1),
(2), (4) Date: Oct. 11, 2011

(87) PCT Pub. No.: WO2010/131805
PCT Pub. Date: Nov. 18, 2010

(65) Prior Publication Data

US 2012/0024164 A1 Feb. 2, 2012

(30) Foreign Application Priority Data

May 11, 2009 (KR) ..... 10-2009-0040994

(51) Int. Cl.

| | |
|---|---|
| ***A47J 37/07*** | (2006.01) |
| ***A21D 2/02*** | (2006.01) |
| ***F24C 14/00*** | (2006.01) |
| ***F24C 15/32*** | (2006.01) |

(52) U.S. Cl.
CPC ..... *F24C 14/005* (2013.01); *F24C 15/327* (2013.01)
USPC ..... 99/339; 99/467; 99/468; 99/469; 99/470; 99/471; 99/472; 99/473; 99/474; 99/475; 99/476; 99/477; 99/478; 99/479; 99/480; 99/481; 99/482; 126/5; 126/20; 126/33; 126/45; 126/53; 126/78; 126/275 R; 219/438; 219/401; 219/472; 392/324

(58) Field of Classification Search
CPC ..... F24C 15/003; F24C 15/327; A47J 27/04; A23L 1/01
USPC ..... 219/461.1, 468.1, 438, 472, 401; 392/309, 397, 478, 324; 126/5, 33, 20, 126/78, 45, 53, 275 R; 99/467–482, 339
See application file for complete search history.

(56) References Cited

U.S. PATENT DOCUMENTS

| | | | | |
|---|---|---|---|---|
| 351 | A * | 8/1837 | Wilson | 126/1 AE |
| RE28 | * | 11/1840 | Williams | 126/1 R |
| 184,148 | A * | 11/1876 | Edwards | 126/45 |
| 225,240 | A * | 3/1880 | Silsbee | 126/20 |

(Continued)

FOREIGN PATENT DOCUMENTS

| | | | |
|---|---|---|---|
| DE | 4427460 | C2 * | 7/1997 |
| JP | 2005-114350 | A | 4/2005 |
| JP | 2007-232270 | A | 9/2007 |
| KR | 10-2009-0030974 | A | 3/2009 |

*Primary Examiner* — Brett Spurlock
(74) *Attorney, Agent, or Firm* — Birch, Stewart, Kolasch & Birch, LLP

(57) ABSTRACT

Provided is a cooking appliance. Steam generated in a steam generation part is selectively supplied into a cooktop part or a steam cooking part. The steam supplied into the cooktop part is used for cleaning a top plate. Also, the steam supplied into the steam cooking part is used for cooking a food. Thus, the steam may be used in a lot of uses, e.g., for cooking the food and cleaning the top plate.

14 Claims, 6 Drawing Sheets

(56) References Cited

U.S. PATENT DOCUMENTS

| | | | | | |
|---|---|---|---|---|---|
| 226,745 | A | * | 4/1880 | Harley | 237/67 |
| 519,750 | A | * | 5/1894 | Wilcox et al. | 126/5 |
| 669,221 | A | * | 3/1901 | Pearce | 126/34 |
| 670,670 | A | * | 3/1901 | Hardaway | 392/309 |
| 724,781 | A | * | 4/1903 | Beale | 126/78 |
| 762,797 | A | * | 6/1904 | Bishop | 126/20.2 |
| 1,053,837 | A | * | 2/1913 | Leonard | 126/1 D |
| 1,217,678 | A | * | 2/1917 | Andrews | 126/53 |
| 1,305,647 | A | * | 6/1919 | Elliott | 126/53 |
| 1,406,850 | A | * | 2/1922 | Hadaway, Jr | 392/309 |
| 1,556,337 | A | * | 10/1925 | Maier et al. | 126/39 H |
| 1,590,581 | A | * | 6/1926 | Irle | 237/2 R |
| 1,659,064 | A | * | 2/1928 | Waters | 126/20.2 |
| 1,762,014 | A | * | 6/1930 | Fischer | 392/309 |
| 1,836,781 | A | * | 12/1931 | Teller | 126/34 |
| 1,866,109 | A | * | 7/1932 | Jackson | 126/39 R |
| 1,881,987 | A | * | 10/1932 | Weiler | 126/37 R |
| 2,059,133 | A | * | 10/1936 | Merritt | 99/339 |
| 2,181,434 | A | * | 11/1939 | Lewis et al. | 99/337 |
| 2,257,580 | A | * | 9/1941 | Trompeter | 219/418 |
| 2,726,715 | A | * | 12/1955 | Tegtmeyer | 431/208 |
| 2,868,108 | A | * | 1/1959 | Petersen | 126/299 D |
| 3,038,986 | A | * | 6/1962 | Molitor | 219/387 |
| 3,156,177 | A | * | 11/1964 | Sanders | 99/339 |
| 3,330,203 | A | * | 7/1967 | Korr | 99/332 |
| 3,355,575 | A | * | 11/1967 | Bassett, Jr. et al. | 219/456.1 |
| 3,682,664 | A | * | 8/1972 | Bennett | 99/339 |
| 3,732,396 | A | * | 5/1973 | Tucker | 219/401 |
| 3,738,256 | A | * | 6/1973 | Joeckel | 99/400 |
| 3,742,931 | A | * | 7/1973 | Bardeau | 126/369 |
| 3,802,413 | A | * | 4/1974 | Pepin | 126/25 B |
| 3,823,661 | A | * | 7/1974 | Kells | 99/468 |
| 3,933,144 | A | * | 1/1976 | Bandy | 126/25 R |
| 4,045,606 | A | * | 8/1977 | Kalkowski | 428/174 |
| 4,111,181 | A | * | 9/1978 | Canney | 126/77 |
| 4,484,065 | A | * | 11/1984 | Ueda | 219/492 |
| 4,495,932 | A | * | 1/1985 | Bratton | 126/20 |
| 4,700,686 | A | * | 10/1987 | Woo | 126/113 |
| 4,889,972 | A | * | 12/1989 | Chang | 219/472 |
| 5,682,811 | A | * | 11/1997 | Kidushim | 99/400 |
| 5,746,114 | A | * | 5/1998 | Harris | 99/331 |
| 5,758,636 | A | * | 6/1998 | Butrimas et al. | 126/211 |
| 5,968,574 | A | * | 10/1999 | Sann | 426/510 |
| 6,060,701 | A | * | 5/2000 | McKee et al. | 219/681 |
| 6,171,630 | B1 | * | 1/2001 | Stanger et al. | 426/510 |
| 6,360,654 | B1 | * | 3/2002 | Cornfield | 99/339 |
| 6,376,817 | B1 | * | 4/2002 | McFadden et al. | 219/681 |
| 6,443,052 | B1 | * | 9/2002 | Garber et al. | 99/339 |
| 6,453,802 | B1 | * | 9/2002 | Manganiello et al. | 99/330 |
| 6,539,839 | B1 | * | 4/2003 | Tippmann | 99/331 |
| 6,782,801 | B1 | * | 8/2004 | Correa et al. | 99/340 |
| 6,956,190 | B2 | * | 10/2005 | Sano et al. | 219/682 |
| 7,173,221 | B2 | * | 2/2007 | Lerner | 219/445.1 |
| 7,188,617 | B1 | * | 3/2007 | O'Blenes | 126/25 R |
| 7,507,939 | B2 | * | 3/2009 | Baumann | 219/732 |
| 8,561,438 | B2 | * | 10/2013 | Jeong et al. | 68/13 R |
| 2001/0045422 | A1 | * | 11/2001 | Gouthiere | 219/432 |
| 2002/0000432 | A1 | * | 1/2002 | Shirakawa et al. | 219/390 |
| 2002/0043529 | A1 | * | 4/2002 | Pickering et al. | 219/452.13 |
| 2004/0031785 | A1 | * | 2/2004 | Muftic | 219/461.1 |
| 2004/0089163 | A1 | * | 5/2004 | Elwedini | 99/450 |
| 2005/0051160 | A1 | * | 3/2005 | Kim | 126/369 |
| 2005/0199136 | A1 | * | 9/2005 | Shingler | 99/482 |
| 2005/0211109 | A1 | * | 9/2005 | Majchrzak et al. | 99/468 |
| 2006/0108433 | A1 | * | 5/2006 | Fossati et al. | 236/44 C |
| 2006/0254429 | A1 | * | 11/2006 | Sinton | 99/348 |
| 2006/0288997 | A1 | * | 12/2006 | Griffin | 126/33 |
| 2007/0017388 | A1 | * | 1/2007 | Lee et al. | 99/467 |
| 2007/0062927 | A1 | * | 3/2007 | Sells et al. | 219/401 |
| 2007/0074713 | A1 | * | 4/2007 | Cadima et al. | 126/21 R |
| 2007/0295322 | A1 | * | 12/2007 | Dobie et al. | 126/21 A |
| 2008/0095904 | A1 | * | 4/2008 | Sullivan et al. | 426/431 |
| 2008/0105136 | A1 | * | 5/2008 | McFadden | 99/339 |
| 2008/0229935 | A1 | * | 9/2008 | Strutin-Belinoff et al. | 99/339 |
| 2009/0078291 | A1 | | 3/2009 | Kang et al. | |
| 2010/0199857 | A1 | * | 8/2010 | Storiz et al. | 99/422 |
| 2011/0162537 | A1 | * | 7/2011 | Chung et al. | 99/473 |
| 2011/0250336 | A1 | * | 10/2011 | Ewald et al. | 426/511 |
| 2011/0303651 | A1 | * | 12/2011 | Mineoka et al. | 219/432 |
| 2012/0031283 | A1 | * | 2/2012 | Kang et al. | 99/339 |

* cited by examiner

COOKING APPLIANCE

CROSS-REFERENCE TO RELATED APPLICATIONS

The present application claims priority under 35 U.S.C. 119 and 35 U.S.C. 365 to Korean Patent Application No. 10-2009-0040994 (filed on May 11, 2009), which is hereby incorporated by reference in its entirety.

BACKGROUND

The present disclosure relates to a cooking appliance, and more particularly, to a cooking appliance in which a top plate is washed using steam.

Cooking appliances are home appliances for heating an object to be heated (hereinafter, referred to as a heated object) using electricity or gas. In recent, such a cooking appliance includes a steam generation part generating steam for cooking heated objects.

SUMMARY

Embodiments provide a cooking appliance which uses steam in a lot of uses.

Embodiments also provide a cooking appliance in which a top plate is washed using steam.

In one embodiment, a cooking appliance includes: a top plate on which an object to be heated is seated on a top surface thereof; a cooktop cover selectively opening or closing the top plate; a heating source heating the object seated on the top plate; and a steam generation part generating steam supplied onto a top surface of the top plate.

In another embodiment, a cooking appliance includes: a top plate on which an object to be heated is seated on a top surface thereof; a cooktop cover selectively opening or closing a top surface of the top plate; a heating source heating the object seated on the top plate; a steam cooking part in which the object is heated by steam, the steam cooking part selectively communicating with a space between the top plate and the cooktop cover; and a steam generation part generating the steam, wherein the top plate includes a steam cooking part, and the steam generated in the steam generation part is supplied into the steam cooking part to heat the object within the steam cooking part or supplied into the space between the top plate and the cooktop cover to clean the top plate.

In further another embodiment, a cooking appliance includes: a top plate on which an object to be heated is seated on a top surface thereof; a cooktop cover selectively opening or closing a top surface of the top plate; a heating source heating the object seated on the top plate; a steam chamber in which the object is heated by steam, the steam chamber being disposed on the top plate; a chamber cover selectively opening or closing the steam chamber; a first sensor detecting whether the top surface of the top plate is opened or closed by the cooktop cover; a second sensor detecting whether the steam chamber is opened or closed by the chamber cover; an input part receiving a first manipulation signal for supplying steam into a space between the top plate and the cooktop cover and a second manipulation signal for supplying the steam into the steam chamber; and a steam generating part generating steam, wherein the top plate includes the steam cooking part, and in case where the input part receives the first or second manipulation signal, the steam generated in the steam generation part is supplied into the steam chamber only when at least one of the first and second sensors detects that the top surface of the top plate is covered by the cooktop cover or the steam chamber is covered by the chamber cover.

The details of one or more embodiments are set forth in the accompanying drawings and the description below. Other features will be apparent from the description and drawings, and from the claims.

DETAILED DESCRIPTION OF THE EMBODIMENTS

Hereinafter, a cooking appliance according to a first embodiment will be described in detail with reference to accompanying drawings.

Figure 1:
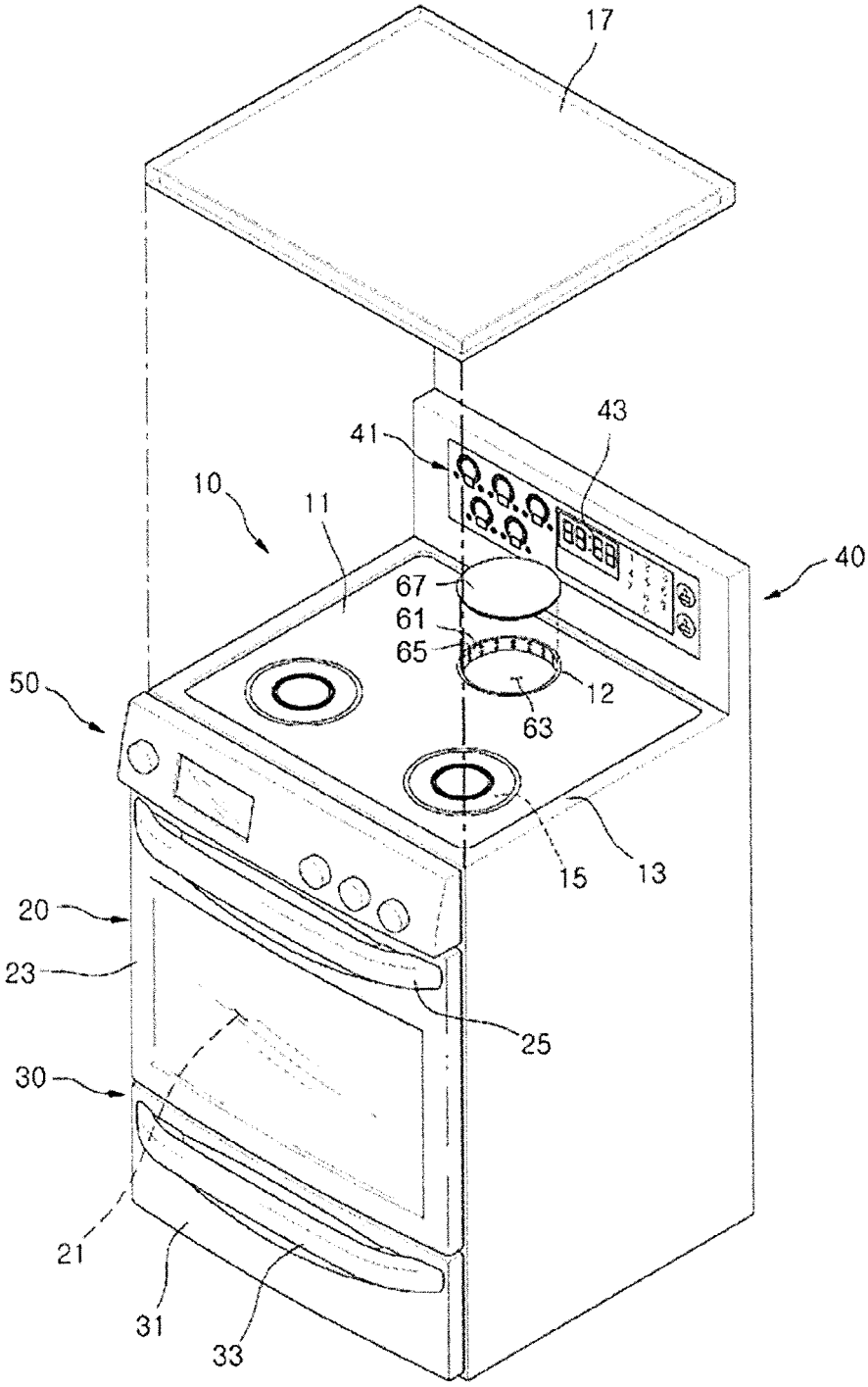
FIG. 1 is a perspective view of a cooking appliance according to a first embodiment.
Figure 2:
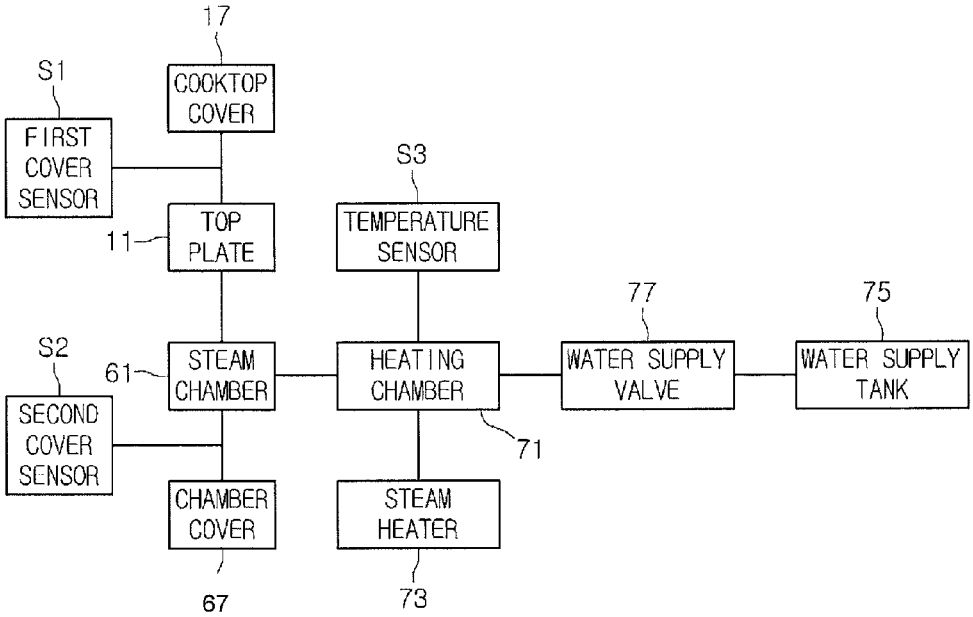
FIG. 2 is a schematic block diagram of the cooking appliance according to the first embodiment.

FIG. 1 is a perspective view of a cooking appliance according to a first embodiment. FIG. 2 is a schematic block diagram of the cooking appliance according to the first embodiment.

Referring to FIG. 1, a cooktop part 10 is disposed on a top surface of a cooking appliance. Also, an oven part 20 and a drawer part 30 are sequentially disposed under the cooktop part 10. A food to be cooked (hereinafter, referred to as a food) is cooked in the cooktop 10 and the oven part 20. The food or a container may be warm in the drawer part 30.

In detail, the top plate 11 defines a top surface of the cooktop 10. A ceramic glass may be used as the top plate 11. The food is seated on the top surface of the top plate 11. Also, a top frame 13 is disposed on an edge of the top plate 11. The top frame 13 has a top surface higher than that of the top plate 11.

An installation opening 12 is defined in a side of the top plate 11. A steam cooking part that will be described later is installed on the installation opening 12. A portion of the top plate 11 is cut to form the installation opening 12. In the current embodiment, a portion of the top plate 11 is cut in an approximately circular shape to form the installation opening 12.

A plurality of heating sources 15 are disposed under the top plate 11. The heating sources 15 may heat the food seated on the top plate 11. A radiant heater or induction heater may be used as the heating sources 15. In the current embodiment, the heating sources 15 are disposed under the top plate 11 so that the heating sources 15 do not vertically overlap the installation opening 12.

The top plate 11 is selectively opened by a cooktop cover 17. The cooktop cover 17 may have a shape in which a predetermined space is defined between the cooktop cover 17 and the top plate 11, e.g., a flat hexahedron shape with an opened bottom side. Also, the cooktop cover 17 may be formed of a partially transparent or semitransparent material to allow a user to confirm the space between the top plate 11 and the cooktop cover 17 through his/her naked eye.

Referring to FIG. 2, the cooktop part 10 includes a first cover sensor S1. The first cover sensor S1 may detect whether the top surface of the top plate 11 is covered by the cook top cover 17.

An oven chamber 21 is defined inside the oven part 20. The food is heated within the oven chamber 21. For this, at least one heating source (not shown) is disposed within the oven chamber 21.

The oven chamber 21 is selectively covered by an oven door 23. A door handle 25 to be grasped by the user to open the oven door 23 is disposed on the oven door 23.

Also, the drawer part 30 includes a drawer 31 withdrawn in a drawer type. The food or container is received into the drawer 31. The drawer part 30 includes a heating source (not shown) for warming the food or container received into the drawer 31. Also, a drawer handle 33 to be grasped by the user to withdraw the drawer 31 is disposed on the drawer 31.

A first control part 40 is disposed on a rear end of the top surface of the cooktop part 10. The first control part includes an input unit 41 (hereinafter, referred to as a 'first input unit') for receiving a manipulation signal for an operation of the cooktop part 10 and a manipulation signal for the supply of the steam into the space between the top plate 11 and the cooktop cover 17 and an output unit 43 (hereinafter, referred to as a 'first output unit') for outputting information with respect to an operation of the cooktop part 10 and information and signal with respect to the supply of the steam into the space between top plate 11 and the cooktop cover 17. Also, the first input unit 41 receives an operation of the steam cooking part, i.e., a manipulation signal for supplying the steam into the steam cooking part, and the first output unit 43 displays information with respect to the operation of the steam cooking part.

Also, a second control part 50 is disposed on an upper portion of a front surface of the oven part 20. The second control part 50 includes an input unit 51 (hereinafter, referred to as a 'second input unit') for receiving manipulation signals for operations of the oven part 20 and the drawer part 30 and an output unit 53 (hereinafter, referred to as a 'second output unit') for outputting information with respect to operations of the oven part 20 and the drawer part 30.

The steam may be selectively supplied into the space between the top plate 11 and the cooktop cover 17 and the inside of the oven chamber 21. The steam supplied into the space between the top plate 11 and the cooktop cover 17 may be used for cleaning the top surface of the top plate 11. Also, the steam supplied into the oven chamber 21 may be used for cooking the food within the oven chamber 21. Also, the steam supplied into the oven chamber 21 may be used for cooking the food.

The steam cooking part is disposed on the installation opening 12. The steam cooking part may receive the steam generated in a steam generation part that will be described later to cook the food. For this, the steam generation part includes a steam chamber 61 and a chamber cover 67.

In more detail, the steam chamber 61 has a cross-sectional area corresponding to that of the installation opening 12 and a polyhedron shape with an opened top side. A cooking space 63 is defined inside the steam chamber 61. The food to be cooked by the steam is received into the cooking space 63. Also, a plurality of steam holes 65 are defined in the steam chamber 61. The steam holes 65 may transfer the steam into the cooking space 63. Although the plurality of steam holes 65 are defined in a circumference surface of the steam chamber 61 in the current embodiment, the present disclosure is not limited thereto. For example, the steam holes 65 may be defined in a bottom surface and/or the circumference surface of the steam chamber 61.

Although not shown, the steam chamber 61 may be detachably disposed on the installation opening 12. Also, a steam housing for preventing condensed water in which the steam supplied into the steam chamber 61 is condensed from being introduced into the cooking appliance may be disposed under the steam chamber 61. Thus, the steam may be supplied into the steam chamber 61 through the steam housing.

The chamber cover 67 selectively opens or closes the opened upper side of the steam chamber 61. For this, the chamber cover 67 may have a plate shape corresponding to that of a cross-sectional area of the steam chamber 61.

Referring to FIG. 2, the steam cooking part includes a second cover sensor S2. The second cover sensor S2 may detect whether the steam chamber 61 is opened or closed by the chamber cover 67.

The steam supplied into the space between the top plate 11 and the cooktop cover 17 and the inside of the steam chamber 61 is generated by the steam generation part. The steam generation part includes a heating chamber 71, a steam heater 73, a water supply tank 75, a water supply valve 77, and a temperature sensor S3.

In detail, steam water for generating steam is stored in the heating chamber 71. The heating chamber 71 is not limited to its shape or size. However, the heating chamber 71 may communicate with the steam chamber 61 or may be connected to supply the steam through the steam hole 65 of the steam chamber 61.

The steam heater 73 heats the steam water stored in the heating chamber 71 to generate steam. Here, various heaters, for example, a sheath heater may be used as the steam heater 73.

The steam water supplied into the heating chamber 71 is stored in the water supply tank 75. The water supply tank 75 may be detachably disposed on a side of the cooking appliance.

The water supply valve 77 may be controlled to selectively supply the steam water stored in the water supply tank 75 into the heating chamber 71.

The temperature sensor S3 detects a temperature of the inside of the heating chamber 71 heated by the steam heater 73. When the temperature of the inside of the heating chamber 71 detected by the temperature sensor S3 is above a preset safety temperature, it may be determined that the amount of the steam water stored in the heating chamber 71 is less than a preset minimum water storage amount or the steam heater 73 is overheated. Thus, in this case, the water supply valve 77 is operated to supply the steam water stored within the water supply tank 75 into the heating chamber 71 or an operation of the steam heater is finished.

Hereinafter, an operation of the cooking appliance according to the first embodiment will be described in detail with reference to accompanying drawings.

To supply the stem into the space between the top plate 11 and the cooktop cover 17, the user inputs a manipulation signal (hereinafter, for convenience of description, referred to as a 'first manipulation signal') into the first input unit 41. When the first input unit 41 receives the first manipulation signal, steam is generated in the steam generation part. Then, the generated steam is supplied into the space between the top plate 11 and the cooktop cover 17 through the steam cooking part. The foreign materials attached to the top surface of the top plate 11 may be soaked by the steam supplied into the space between the top plate 11 and the cooktop cover 17. Thus, the top plate 11 may be more easily cleaned.

In detail, the steam heater 73 heats the steam water stored in the heating chamber 71 to generate steam. The steam generated by heating the steam water stored in the heating chamber 71 using the steam heater 73 may be supplied into the steam cooking part, and more particularly, into the space between the top plate 11 and the cooktop cover 17 through the steam chamber 61.

When the steam is completely supplied into the space between the top plate 11 and the cooktop cover 17, the first output unit 43 outputs a signal for informing the completion of the steam supply. For example, the first output unit 43 may inform the completion of the steam supply through sound, character, emblem, beep sound, or illumination. Also, when the steam supply into the space between the top plate 11 and the cooktop cover 17 is completed and a preset time elapses, the first output unit 43 outputs a signal for informing the completion of the steam supply and the time elapse. This is done for a reason which is for informing a time for soaking the foreign materials attached to the top plate 11 using the steam supplied into the space between the top plate 11 and the cooktop cover 17 to the user.

Also, when the first input unit 41 receives the first manipulation signal in a state where the first cover sensor S1 detects the opening of the top surface of the top plate 11 through the cooktop cover 17 or the second cover sensor S2 detects that the steam chamber 61 is covered by the chamber cover 67, the first output unit 43 outputs a signal for informing this state. Also, during the supply of the steam into the space between the top plate 11 and the cooktop cover 17, when the first cover sensor S1 detects the opening of the top surface of the top plate 11 by the cooktop cover 17, the first output unit 43 outputs a signal for informing this state. Also, during the supply of the steam into the space between the top plate 11 and the cooktop cover 17, when the first cover sensor S1 detects the opening of the top surface of the top plate 11 by the cooktop cover 17, the supply of the steam into the space between the top plate 11 and the cooktop 17 is stopped.

This is done for a reason in which it prevents the steam from being unnecessarily supplied or spread to the outside to damage the user in the state where the top plate 11 is opened by the cooktop cover 17 or the steam chamber 61 is covered by the chamber cover 67. Thus, the user may cover the top plate 11 using the cooktop cover 17 and open the steam chamber 61 using the chamber cover 67 to supply the steam into the space between the top plate 11 and the cooktop cover 17.

To supply the steam into the steam chamber 61, the user inputs a manipulation signal (hereinafter, for convenience of description, referred to as a 'second manipulation signal') into the first input unit 41. When the first input unit 41 receives the second manipulation signal, the steam is supplied into the steam chamber 61. Also, the steam supplied into the steam chamber 61 may be used for cooking the foods within the steam chamber 61.

When the first input unit 41 receives the second manipulation signal in a state where the second cover sensor S2 detects the covering of the steam chamber through the chamber cover 67, the first output unit 43 output a signal for informing this state. Also, during the supply of the steam into the steam chamber 61, when the second cover sensor S2 detects the opening of the steam chamber 61 by the chamber cover 67, the first output unit 43 outputs a signal for informing this state. Also, during the supply of the steam into the steam chamber 61, when the second cover sensor S2 detects the opening of the steam chamber 61 through the chamber cover 67, the supply of the steam into the steam chamber 61 is stopped.

This is done for a reason in which it prevent the steam from being unnecessarily supplied or spread to the outside to damage the user in the state where the steam chamber 61 is opened by the chamber cover 67. Thus, the steam may be supplied into the steam chamber 61 after the steam chamber 61 is closed by the chamber cover 67.

Hereinafter, a cooking appliance according to a second embodiment will be described in detail with reference to accompanying drawings.

Figure 3:
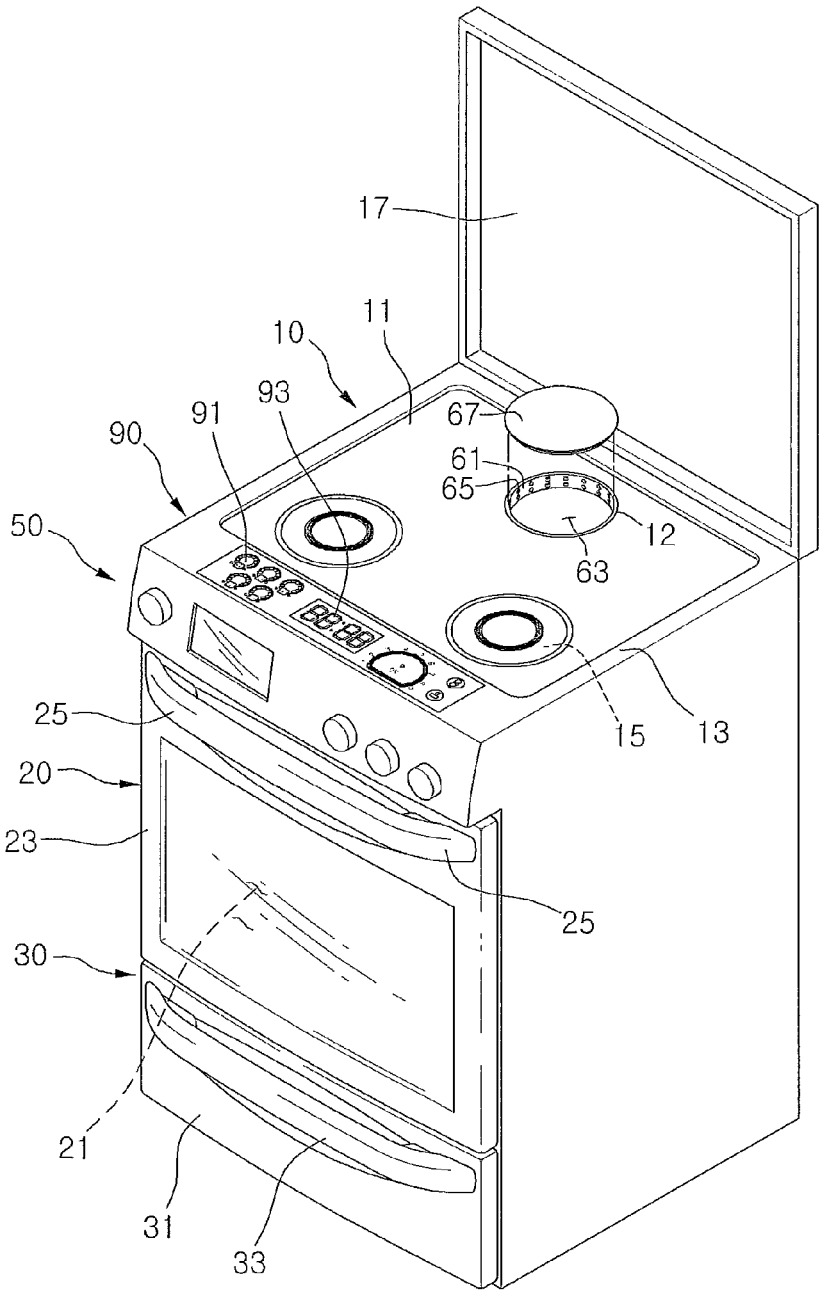
FIG. 3 is a perspective view of a cooking appliance according to a second embodiment.

FIG. 3 is a perspective view of a cooking appliance according to a second embodiment. Here, the fundamentally same portions as those of the above first embodiment are denoted by the same reference numerals as those of FIGS. 1 and 2 and their detained descriptions will be omitted.

Referring to FIG. 3, a cooktop cover 17 is rotatably disposed with respect to a rear end thereof to selectively open or close a top plate 11. Thus, to cook a food using a heating source 15 in a cooktop part 10, a user rotates the cooktop cover 17 with respect to the rear end thereof to open the top plate 11. Also, to remove foreign materials from a top surface of the top plate 11 using steam, the cooktop cover 17 is rotated with respect to the rear end thereof to open the top plate 11.

In the current embodiment, a first control part 40 is disposed on a front end of the top surface of the cooktop part 10. This is done for a reason in which the cooktop cover 17 is rotated to open the top plate 11 under the control of the first control part 40 without interfering. The first control part 40 includes an input unit 41 for receiving a manipulation signal for operations of the cooktop part 10 and a steam cooking part and a manipulation signal for supplying steam into a space between the top plate 11 and the cooktop cover 17 and the inside of the steam chamber 61 and an output unit 43 for outputting information and signal with respect to an operation of the cooktop part 10, information and signal with respect to the supply of the steam into the space between the top plate 11 and the cooktop cover 17, and information and signal with respect to an operation of the steam chamber 61.

Hereinafter, a cooking appliance according to second and third embodiments will be described in detail with reference to accompanying drawings.

Figure 4:
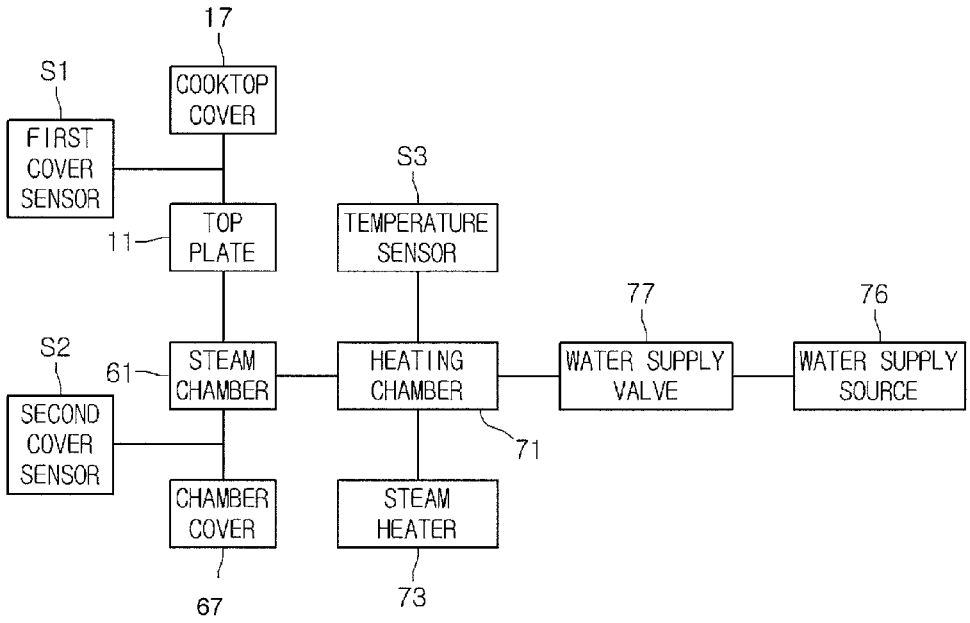
FIG. 4 is a schematic block diagram of a cooking appliance according to a third embodiment.
Figure 5:
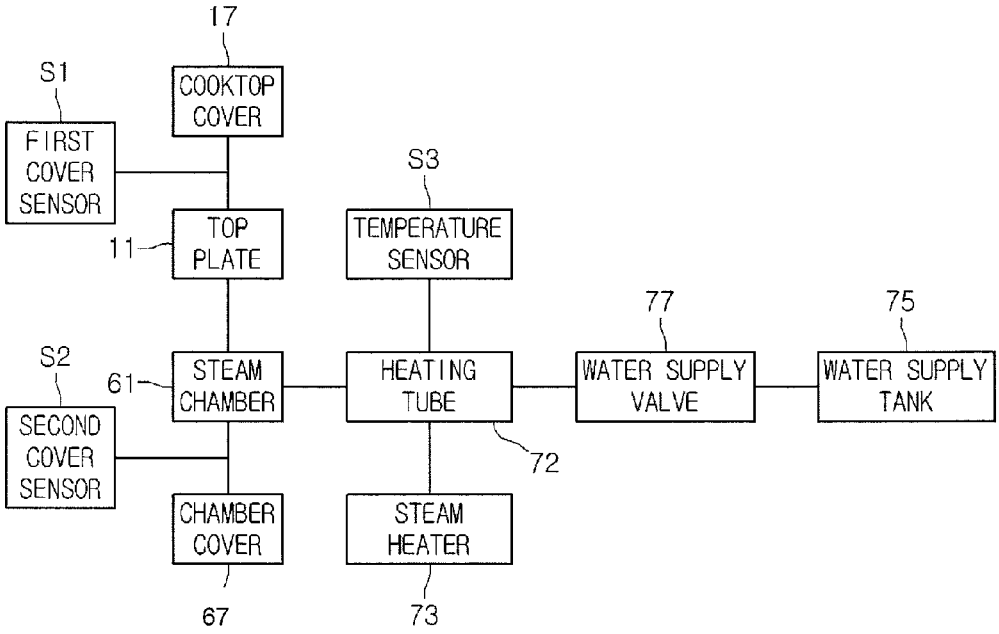
FIG. 5 is a schematic block diagram of a cooking appliance according to a fourth embodiment.

FIG. 4 is a schematic block diagram of a cooking appliance according to a third embodiment. FIG. 5 is a schematic block diagram of a cooking appliance according to a fourth embodiment.

Referring to FIG. 4, in the third embodiment, steam water is directly transferred from an external water supply source 76 to a heating chamber 71. Thus, it is unnecessary to store the steam water in a water supply tank 75 to supply the steam water into the heating chamber 71.

Referring to FIG. 5, in the fourth embodiment, the steam water stored in the water supply tank 75 flows into a heating tube 72. The steam water flowing into the heating tube 72 is heated by a steam heater 73 to generate steam. That is to say, in the current embodiment, the steam water stored in the water supply tank 75 is heated by the steam heater 73 while flowing into the heating tube 72, but is not stored in the water supply tank 75. Thus, it may prevent the heating chamber 71 from being contaminated by the steam water that is not heated by the steam heater 73, but remains in the heating chamber 71.

Since the rest parts of the third and fourth embodiments are equal to those of the first or second embodiment, their detailed descriptions will be omitted.

Hereinafter, a cooking appliance according to a fifth embodiment will be described in detail with reference to accompanying drawings.

Figure 6:
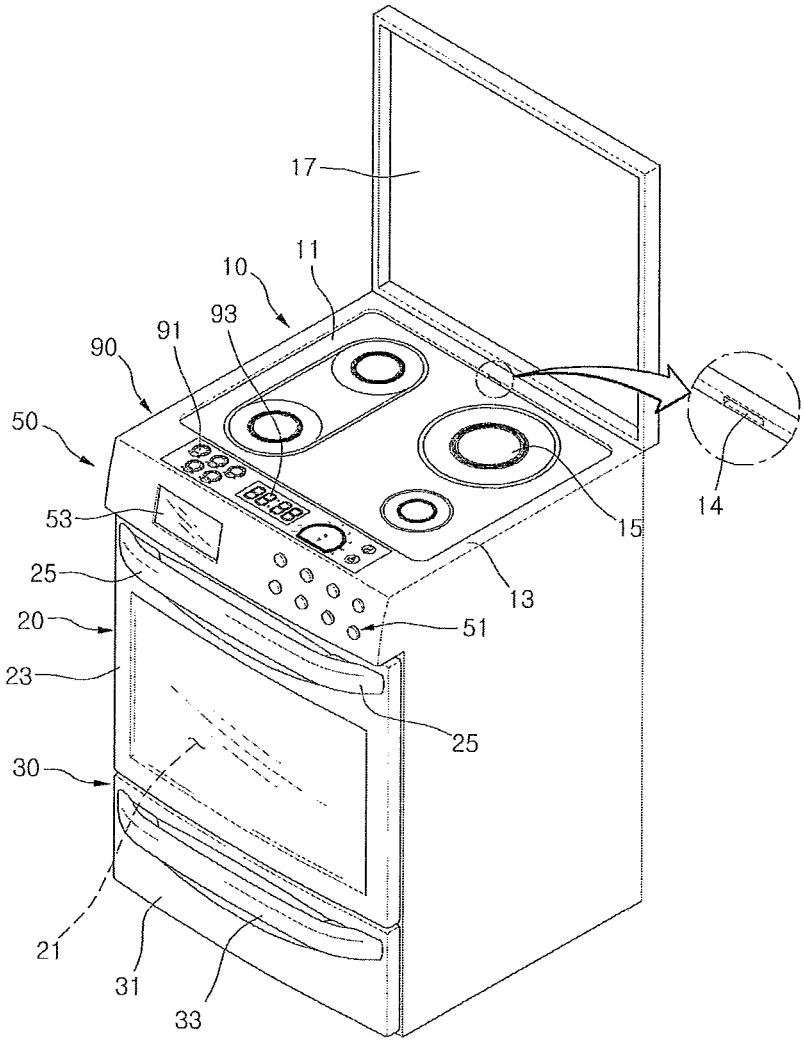
FIG. 6 is a perspective view of a cooking appliance according to a fifth embodiment.

FIG. 6 is a perspective view of a cooking appliance according to a fifth embodiment. Here, the fundamentally same portions as those of the above first embodiment are denoted by the same reference numerals as those of FIGS. 1 and 2 and their detained descriptions will be omitted.

Referring to FIG. 6, in the fifth embodiment, a stem supply hole 14 is defined in a cooktop part 10. Thus, steam is injected into a space between a top plate 11 and a cooktop cover 17 through the steam supply hole 14. That is, in the current embodiment, the steam cooking part of the first embodiment may be omitted. Also, the steam supply hole 14 for supplying the steam into the space between the top plate 11 and the cooktop cover 17 may be defined. Thus, in the current embodiment, the steam may be directly supplied into the space between the top plate 11 and the cooktop cover 17 through the steam supply hole 14 without passing through the separate steam cooking part.

It should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims.

In the above-described embodiments, although the steam generated in the steam generation part is supplied into the steam cooking part, i.e., the space between the top plate and the cooktop through the steam chamber, the present disclosure is not limited thereto. That is, the steam generated in the steam generation part may be supplied into the space between the top plate and the cooktop cover through a separate steam injection hole or nozzle.

Also, the chamber cover may be rotatably disposed on the top plate or the steam chamber. However, when the chamber cover is rotated to open or close the steam chamber, it should prevent the manipulation of the heating source or the first control part from interfering.

According to the embodiments, the steam may be used for cooking the food and cleaning the top plate.

As described above, in the cooking appliance according to the embodiments, the following effects may be expected.

The steam generated in the one steam generation part may be selectively used for cleaning the cooktop part and cooking the food in the steam cooking part. Thus, the steam generated in the one steam generation part may be used in a lot of uses.

Also, the foreign material attached to the top surface of the top plate may be cleaned by the steam supplied into the cooktop part. Therefore, the cooktop part may be more easily cleaned.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cooking appliance, comprising:

a cooktop part including:

a top plate on which food or a container for cooking is placed; and a cooktop cover selectively opening or closing a top surface of the top plate; and a first control part to input an operation command, wherein the top plate includes:

a plurality of heating sources installed therein and configured to heat the food or the container on the top plate, the plurality of heating sources configured to be disposed a predetermined distance away from each other;

a steam cooking part installed therein to cook food using steam, the steam cooking part configured to be disposed a predetermined distance away from the plurality of heating sources; and an installation opening to receive the steam cooking part, wherein the steam cooking part includes:

a steam chamber received in the installation opening, the steam chamber including:

an upper surface which is opened;

a side surface downwardly extending from the top surface of the top plate in a predetermined length;

a bottom surface formed at a lower end of the side surface; and a plurality of steam holes formed in at least one of the side surface and the bottom surface, to introduce the steam into the cooking space; and a chamber cover detachably disposed in the installation opening to selectively open or close the upper surface of the steam chamber, an oven chamber disposed below the cooktop part; and a second control part to control a manipulation of the oven chamber, wherein the second control part includes:

a second input unit for receiving manipulation signals for operation of the oven chamber; and a second output unit for outputting information with respect to operation of the oven chamber, whereby steam may be selectively supplied into the space between the top plate and the cooktop cover and the inside of the oven chamber.

2. The cooking appliance of claim 1, further comprising a first sensor configured to detect opening of the top surface of the top plate by the cooktop cover.

3. The cooking appliance of claim 2, further comprising a second sensor configured to detect opening of the upper surface of the steam chamber by the chamber cover.

4. The cooking appliance of claim 3, wherein the first control part includes:

an input unit to receive one of or both a manipulation signal for an operation of the cooktop part and manipulation signal for a supply of the steam into the steam chamber; and an output unit to output one of or both information with respect to the operation of the cooktop part and information with respect to the supply of the steam into the steam chamber.

5. The cooking appliance of claim 4, further comprising a steam generating part to generate steam, wherein the steam generating part includes:

one of a heating chamber and a heating tube to store water for generating steam;

a steam heater disposed in the heating chamber to heat the water supplied to the heating chamber;

a water supply source to supply the water for generating steam to the heating chamber, the water supply source including at least one of a water tank and a water supply source; and a temperature sensor to detect a temperature of an inside of the heating chamber.

6. The cooking appliance of claim 5, wherein the steam generated in the heating chamber is supplied to the steam chamber of the steam cooking part, when the top plate is covered by the cooktop cover and the manipulation signal to supply steam is received.

7. The cooking appliance of claim 5, wherein the steam generated in the heating chamber is supplied to the steam chamber of the steam cooking part, when the steam chamber is covered by the chamber cover and the manipulation signal to supply steam is received.

8. The cooking appliance of claim 5, wherein the steam generated in the heating chamber is supplied to a space between the top plate and the cooktop cover through the steam chamber, when the top plate is covered by the cooktop cover, the steam chamber is not covered by the chamber cover, and the manipulation signal to supply steam is received.

9. The cooking appliance of claim 5, wherein the steam generated in the heating chamber is not supplied to the steam chamber, when the top plate and the steam chamber are not respectively covered by the cooktop cover and the chamber cover, but the manipulation signal to supply steam is received.

10. The cooking appliance of claim 5, wherein the output unit is configured to output a signal for informing at least one of completion of the steam supply into a space between the top plate and the cooktop cover or into the steam chamber.

11. The cooking appliance of claim 5, wherein the output unit is configured to output a signal for informing at least one of an elapse of a preset time for supplying the steam into a space between the top plate and the cooktop cover or into the steam chamber.

12. The cooking appliance of claim 1, wherein the cooktop cover is configured to be completely separable from the top plate.

13. The cooking appliance of claim 1, wherein the cooktop cover is configured to be hinged to a rear edge portion of the top plate to be rotatable with respect to the top plate.

14. The cooking appliance of claim 1, wherein the steam cooking part further includes a steam housing accommodating the steam chamber, and disposed under the top plate.

* * * * *